US005802872A

United States Patent [19]

Billingham et al.

[11] Patent Number: 5,802,872

[45] Date of Patent: Sep. 8, 1998

[54] CRYOGENIC AIR SEPARATION WITH COMBINED PREPURIFIER AND REGENERATORS

[75] Inventors: John Fredric Billingham, Getzville; Dante Patrick Bonaquist, Grand Island; James Robert Dray, Kenmore, all of N.Y.

[73] Assignee: Praxair Technology, Inc., Danbury, Conn.

[21] Appl. No.: 902,919

[22] Filed: Jul. 30, 1997

[51] Int. Cl.[6] ..... F25J 1/00

[52] U.S. Cl. ..... 62/641; 62/644; 62/909

[58] Field of Search ..... 62/644, 909, 641

[56] References Cited

U.S. PATENT DOCUMENTS

| | | | |
|---|---|---|---|
| 1,945,634 | 2/1934 | Frankl | 183/115 |
| 2,825,212 | 3/1958 | Linde | 62/175.5 |
| 3,508,412 | 4/1970 | Yearout | 62/13 |
| 3,950,957 | 4/1976 | Zakon | 62/644 |
| 4,133,662 | 1/1979 | Wagner | 62/13 |
| 4,367,082 | 1/1983 | Tomisaka et al. | 62/909 |
| 4,557,735 | 12/1985 | Pike | 55/26 |

*Primary Examiner*—Ronald C. Capossela
*Attorney, Agent, or Firm*—Stanley Ktorides

[57] ABSTRACT

A method is provided for separation of air by cryogenic rectification comprising compressing feed air, passing the compressed feed air through a prepurifier wherein the air is substantially cleaned of impurities, thereafter cooling the cleaned air in a cooled regenerator and then introducing it into a cryogenic air separation facility wherein it is separated into nitrogen-rich and oxygen-rich components.

10 Claims, 6 Drawing Sheets

CRYOGENIC AIR SEPARATION WITH COMBINED PREPURIFIER AND REGENERATORS

FIELD OF THE INVENTION

This invention relates to the cryogenic separation of air wherein regenerators are used to cool feed air prior to introducing the feed air into a cryogenic air separation facility.

BACKGROUND ART

Large scale commercial production of industrial gases from the atmosphere generally involves cryogenic processing of air. In addition to desired products such as oxygen, nitrogen, argon and the rare gases, air used as a starting material for cryogenic processing (feed air) also contains impurities or undesirable components such as water vapor, carbon dioxide and one or more hydrocarbon species. These impurities must be removed before processing of feed air can be completed because the impurities interfere with continuous and efficient operation of the cryogenic equipment, or may present hazardous conditions which imperil the safety of operators or damage equipment. A significant portion of the cost of an air separation plant is associated with cleaning or prepurifying air and with cooling the air to cryogenic temperatures.

Various techniques have been used to provide air separation systems with clean, low temperature air streams. Heat exchangers allow simultaneous cooling of feed air and reheating of product streams. Feed air and product streams flow in separate passages through the heat exchanger. Early air separation systems allowed impurities to deposit on the cold heat exchange surfaces in the feed air passages, eventually causing the heat exchanger to become plugged with condensed impurity deposits or to become unable to cool the incoming air to the required low temperature for cryogenic separation. The plant would then be shut down and thawed out. Later plants incorporated chillers for the removal of part of the moisture, and caustic scrubbers to remove carbon dioxide. As the demand for gaseous products grew, devices known as regenerators came into use to accomplish heat exchange between feed air and product streams.

A regenerator comprises an insulated pressure vessel filled with a packing material. The regenerator is alternately heated and cooled by sequentially passing a warm feed air stream followed by a cold product stream through it. This differs from a heat exchanger which has both heating and cooling streams passing through it simultaneously. In a regenerator, heat is retained by, or lost by, the walls and packing material, which were in turn cooled or heated by the previous stream of gas. The passage of feed air through a regenerator removes the moisture and carbon dioxide from the feed air as the air is cooled to near saturation temperature. Operating regenerators in pairs, alternating between the feed air and cold returning streams, allows the plant to continue operating economically for up to a year. Such a system is described in U.S. Pat. No. 1,945,634. When a cold returning stream is warmed by passing through a regenerator, the stream will mix with residual feed air, and will also vaporize any impurities condensed in the regenerator. If the stream is intended to be a clean product, this results in contamination of product with residual feed air and with impurities vaporized into the stream. In order to avoid this, regenerators are purged occasionally with a gas stream to vaporize condensed impurities and sweep them out to the atmosphere, thus wasting energy. U.S. Pat. No. 2,825,212 describes use of adsorbents in the regenerators to remove impurities from the feed air, but this arrangement does not avoid the necessity for frequent purging of the regenerators and adsorbents to remove condensed impurities. To obtain clean products without wasteful purging, coils are typically embedded in the regenerators to provide a separate passage for the high purity dry products without the opportunity for contamination with feed air or condensed impurities. However, such coils are known to fail due to puncture, allowing contamination of product with feed air, and are believed to accelerate particle attrition.

Adsorption technology is now widely used to remove the moisture, carbon dioxide and hydrocarbons from the feed air stream. In many instances a chiller precedes the adsorption system to remove much of the moisture and reduce the dehydration load on the adsorption system. This system then provides a dried, and clean air stream to the plant. Application of this method, with molecular sieves being employed as the adsorbent medium, is described in U.S. Pat. No. 4,557,735. This reference describes cooling compressed feed air and then passing the cooled air through an adsorbent material. This cooled air still needs to be cooled further to cryogenic temperatures before it is fed to a cryogenic separation system. This function, known as primary heat exchange, is typically performed in brazed aluminum heat exchangers (BAHX).

SUMMARY OF THE INVENTION

A method is provided for separation of air by cryogenic rectification comprising compressing feed air, passing the compressed feed air through a prepurifier wherein the air is substantially cleaned of impurities and cooling the cleaned air in a previously cooled regenerator prior to introducing it into a cryogenic air separation facility wherein it is separated into nitrogen-rich and oxygen-rich components. In a preferred embodiment of the invention, a portion of the cleaned air is cooled in a heat exchanger.

The capital cost of adsorbent prepurifiers followed by BAHX cores is quite substantial. A process employing regenerators with the use of prepurifiers provides several advantages over the presently used system. The inefficiency incurred in passing air through the regenerators to remove condensed impurities is significantly reduced. In addition, no refrigeration losses are incurred from condensing impurities in the feed air. Perhaps more importantly, the reliability and safety performance of prepurified plants is increased over plants that use reversing heat exchangers or regenerators to remove water and carbon dioxide followed by cold adsorption of hydrocarbons.

In addition, the invention which removes substantially all of the impurities from the air feed to the plant with a prepurification system, eliminates the need to design and operate the regenerators to also remove contaminants. This allows the equipment to be optimized specifically to accomplish heat transfer only, increasing its efficiency while decreasing materials and operating costs and providing significant economic advantages over current processes.

Even greater advantages may be achieved if the product streams were passed through a BAHX, with the regenerators being cooled only by waste streams as this allows production of higher-purity product with fewer operational problems.

DETAILED DESCRIPTION OF THE INVENTION

Figure 1:
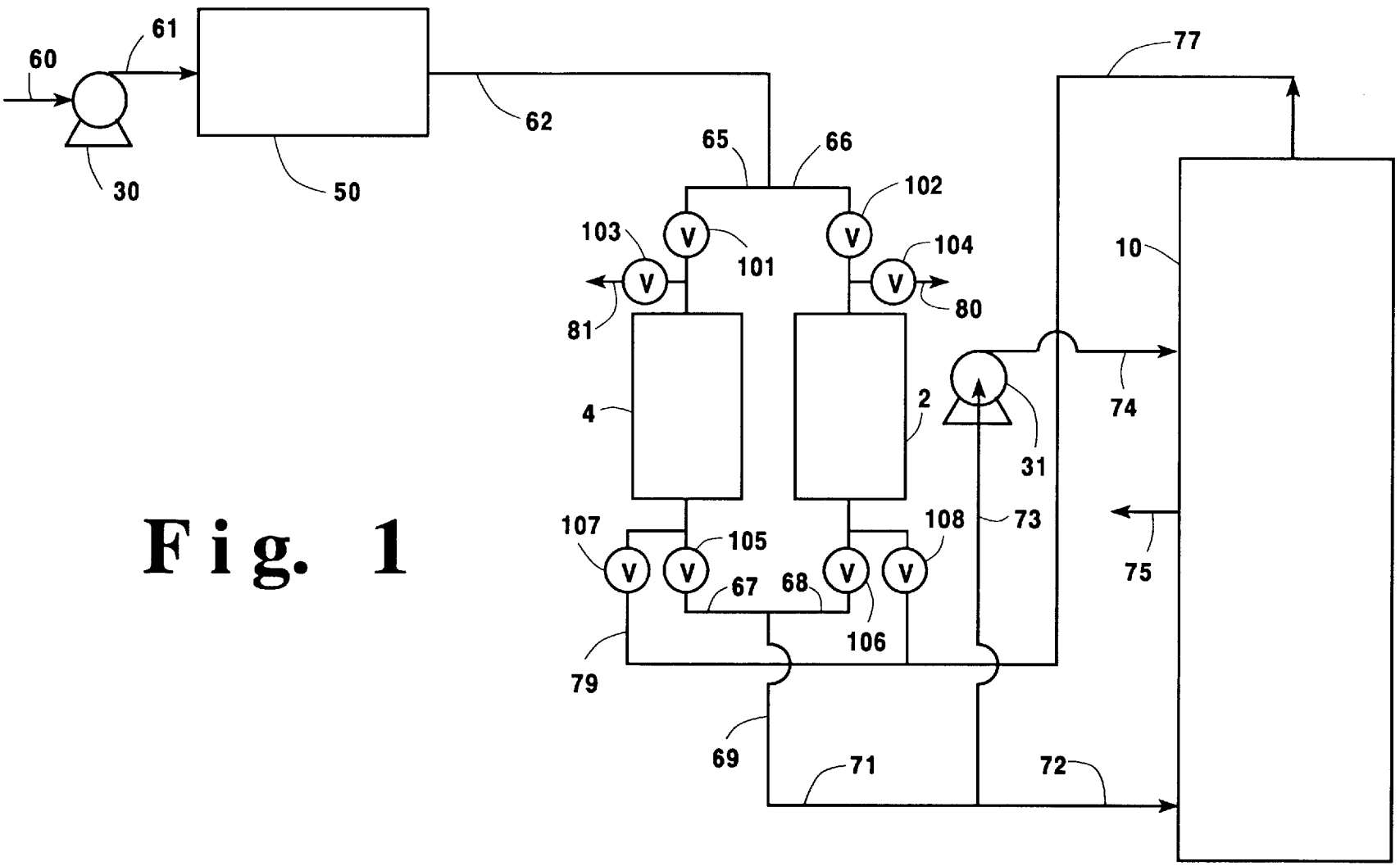
FIG. 1 is a schematic representation of an embodiment of the invention.

In the method of this invention, feed air containing impurities such as water vapor, carbon dioxide and hydrocarbons, is prepurified to substantially remove all the impurities, and the purified feed air is then cooled in regenerators. Regenerators are designed more conveniently and economically to cool prepurified feed air rather than raw feed air. For example, regenerators operating on prepurified air streams can be made shorter than those that process wet air, since they are not required to perform a condensing duty.

In addition, self-cleaning cycles in which the regenerators are purged of condensed impurities are unnecessary. This eliminates the need to maintain very small temperature differences along the regenerator during operation to enable evaporation of the condensed material during passage of the returning non-product stream, henceforth termed the waste stream. This greatly improves operability of regenerators since there is no potential for blockage. Elimination of the cleaning cycle also conserves power. Because the air entering the regenerators is dry, all of the air that is passed through the regenerators may be passed from the regenerator cold end and processed in the cryogenic separation system to make product. None of the air need be sent out as a waste stream due to contamination with condensed impurities, a process referred to as blow down, thus eliminating a major component of energy loss from the process.

Further, since the streams processed by the regenerators are clean, more choices of packing material for the regenerators are available. Traditional ceramic packing materials, such as quartz gravel or alumina balls may be used. Other packing materials can include metallic materials such as steel or aluminum spheres. However, the absence of condensation and evaporation cycles in the method of this invention reduces particle attrition, allowing use of inexpensive, porous material, such as iron ore pellets. An additional advantage of iron ore pellets is their higher heat capacity relative to traditional quartz gravel or alumina ball packings, which increases the efficiency of the regenerators. Generally the regenerators are upright cylindrical vessels, but other vessel configurations are suitable.

Regenerators also enjoy a tremendous cost advantage over brazed aluminum core heat exchangers. Multiple parallel BAHX cores are often necessary to handle large flows because there is a practical size limitation on a single BAHX core imposed by the size of the brazing furnaces available. Two regenerators consisting of easily manufactured and relatively inexpensive pressure vessels containing particulates may replace multiple BAHX cores. The regenerators do require switching valves and check valves, but these can be externally insulated and the accompanying pipework is simple, in contrast to the complex manifolds and air trimming valves required on the feed line to each BAHX core to control the air being passed to them. The multiple BAHX cores needed to equal the heat transfer capability of two regenerators would thus require a much greater investment in piping and valves in addition to the higher cost of the cores. Further, these factors cause the lead time required for manufacture of BAHX cores to be significantly longer than that for regenerators.

An embodiment of this invention is shown schematically in FIG. 1. Feed air delivered in suction piping 60 is compressed in compressor 30 to an operating pressure in the range from 40 to 200 psia, preferably above 60 psia. The compressed air is then aftercooled, preferably to a temperature in the range from 1°to 40° C., and delivered to the prepurification system 50 through piping 61. The prepurification system may be any of the systems well known to the industry. These may include but are not necessarily limited to: chillers to reduce the dehumidification load, alternating alumina beds for moisture removal in combination with alternating molecular sieve beds to remove the carbon dioxide and hydrocarbons. The adsorbers may be regenerated by any of several well known alternative methods. The prepurifier adsorbent beds may be composed of a single adsorbent for all contaminants, a separate adsorbent for each contaminant, or compound material beds. Further, the prepurifier system can include single or multiple vessels containing adsorbent material. Still further, the prepurifier system can operate on the thermal swing, pressure swing, or combined temperature and pressure swing operating principle. The type of prepurifier system is not limited for use in this invention, as long as the prepurifier system performs the task of removing the moisture, carbon dioxide, and hydrocarbon contaminants in the feed air. Many different prepurifier systems are well known in the prior art.

The clean, dry air leaving prepurification system 50 in piping 62 is then passed in piping 66 and 65 to regenerators 2 and 4. Regenerator 2 is fed clean, dry air through automatic switching valve 102. Regenerator 2 including the packing or storage material therein has been previously cooled by the passage therethrough of the waste stream from the cryogenic air separation facility 10. The clean air passing through cooled regenerator 2 is cooled to approximately its saturation point. The saturated air will then either pass through check valve 106, piping 68, 69, 71, and 72 to the cryogenic air separation facility 10 where further cryogenic processing will accomplish the separation of the air into its desired products, or through check valve 106, piping 68, 69, 71, and 73 to turbine 31 where it will be further cooled prior to entering the separation plant 10 through piping 74. Generally, the fraction of the feed air that is turboexpanded to develop plant refrigeration will range from 5 to 20% of the total feed air with 10 to 15% as the preferred fraction. The cryogenic air separation facility 10 is typically a double column configuration as is well known in the art, but the may also be a single column arrangement. Further, the double column configuration can be any of the many variations that are available in the art. The other regenerator 4 will be processing the cold waste stream from separation plant 10 which will be cooling the packing of regenerator 4 after passing through piping 77, 79 and check valve 107 at its cold end. The packing or storage material of regenerator 4 holds the refrigeration passed to it from the waste stream in intermediate storage for the subsequent transfer to clean feed air. The waste stream then leaves cooled regenerator 4 through automatic switching valve 103 and is vented to the atmosphere through piping 81. The product leaves the cryogenic air separation facility through piping 75. Although product stream 75 is shown as exiting the cryogenic separation facility 10 directly, it should be understood that this product stream can be rewarmed versus a fraction of the feed air. If the product stream 75 is in liquid form, it can be recovered directly from the cryogenic separation system. However, if the product stream 75 is a gaseous product, it can be rewarmed versus a fraction of the feed air in either separate regenerators, embedded coils in regenerators 2 and 4, or in separate heat exchangers as will be described in the following sections. FIG. 1 illustrates only the combined prepurifier and waste nitrogen regenerators for purposes of clarity.

A disadvantage of conventional regenerators is that, if a product stream passes through a regenerator, it may be contaminated with residual feed air. Isolation of the product stream in a separate passage from that used for feed air can potentially increase product purity. This has typically been achieved by passing the product stream through separate coils imbedded in the regenerator packing. However, these coils often fail due to puncture, allowing contamination of product. They are also believed to accelerate attrition of the particulate packing material in the regenerator. Alternatively several regenerators may be used with each regenerator seeing only one stream at any time. The difficulty with this arrangement is that clean products will be contaminated with air on flow reversal and valving will tend to leak a little resulting in reduced product purity.

In a preferred embodiment of this invention, the problem of product contamination in the regenerators has been solved by heating only the waste stream in the regenerators. In this embodiment, the product stream is typically warmed in BAHX cores. Preferably, the feed air is split between the regenerators and the BAHX to balance the temperature profile in both. The fraction passing through the regenerators is preferably 40 to 80 percent, and most preferably about 60 to 80 percent. Thus, this arrangement maintains the flexibility of using the cores, which readily handle multiple streams, and isolate product from feed air, while having a significant portion of the heat exchange accomplished using the more cost-effective regenerators. Another advantage of this arrangement is that, because the regenerators are not designed with separate coils to provide clean passages for product streams, it is possible to fill the vessels with large structured fill (monolith). Such fill may comprise, for example, of corrugated sheets. Such packings provide a higher heat transfer rate for a given pressure drop. This also allows the cross sectional area of the vessels to be decreased.

Figure 2:
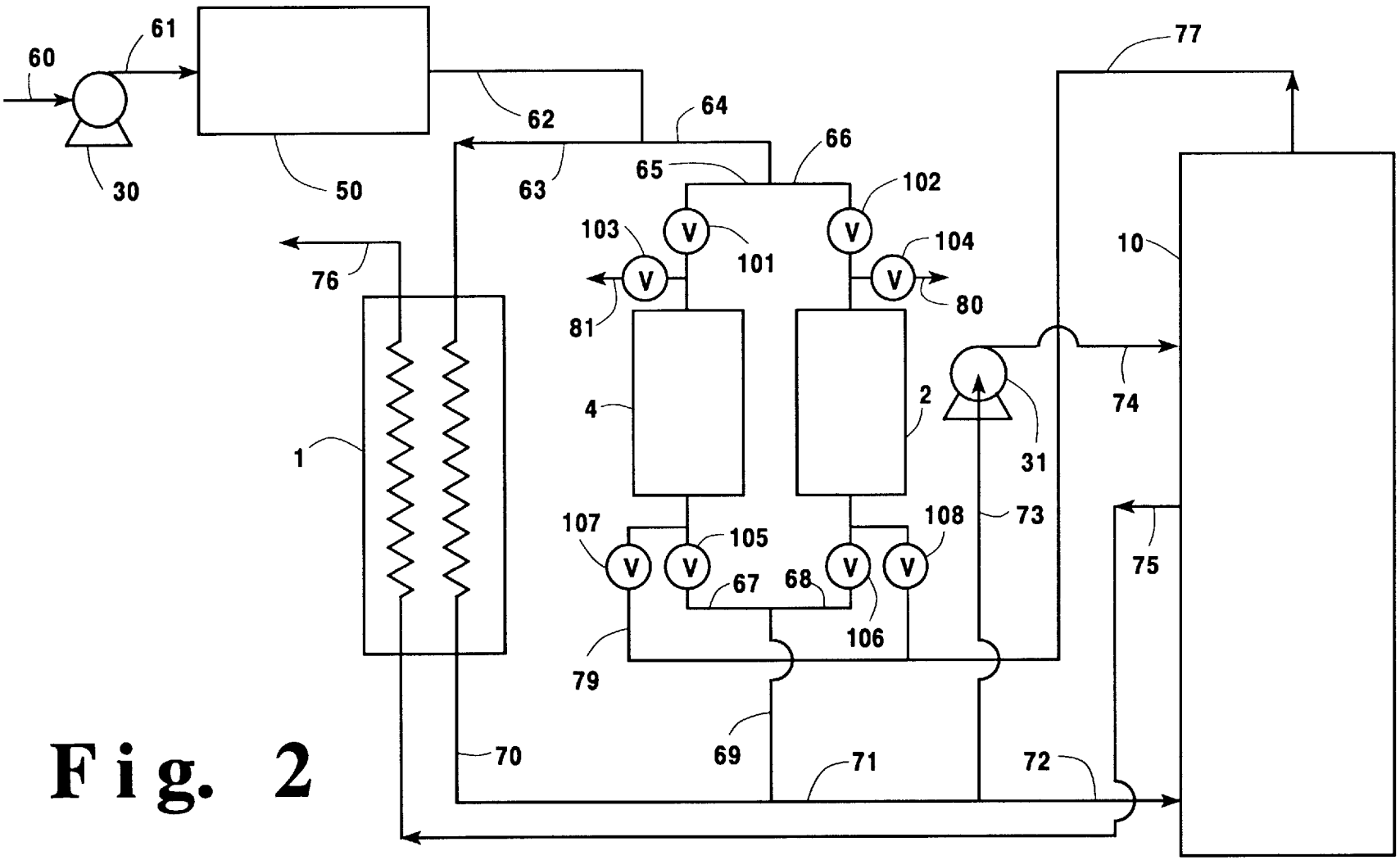
FIG. 2 is a schematic representation of a preferred embodiment of the invention.

A preferred embodiment of this invention is shown schematically in FIG. 2. Feed air delivered in suction piping 60 is compressed in compressor 30 to an operating pressure in the range from 40 to 200 psia, preferably above 60 psia. The compressed air is then aftercooled, preferably to a temperature in the range from 1° C. to 40° C., and delivered to the prepurification system 50 through piping 61. The clean, dry air leaving prepurification system 50 in piping 62 is then split into two portions, one being passed in piping 64 to regenerators 2 and 4 and the remainder passing to primary heat exchanger 1 through piping 63. Regenerator 2 is fed clean, dry air through piping 66 and automatic switching valve 102, the packing of regenerator 2 having been previously cooled by the waste stream from the cryogenic separation facility 10, thus cooling the incoming clean air to approximately its saturation point. The saturated air is then either passed through check valve 106, piping 68, 69, 71, and 72 to the cryogenic separation section 10 where further cryogenic processing will accomplish the separation of the air into its desired products, or through check valve 106, piping 68, 69, 71, and 73 to turbine 31 where it will be further cooled prior to entering the separation plant 10 through piping 74. The other regenerator 4 will be processing the cold waste stream from separation plant 10 which will be cooling the packing of regenerator 4 after passing through piping 77, 79 and check valve 107 at its cold end. The waste stream then leaves regenerator 4 through automatic switching valve 103 at its warm end and is vented to the atmosphere through piping 81.

The remainder of the clean, dry air from the prepurification system 50 and piping 62 is passed through piping 63 to primary heat exchanger 1 where it is balanced against the product stream leaving cryogenic separation facility 10 in piping 75 through primary heat exchanger 1 and warm end piping 76 in a continuous manner. The split of the feed air between the regenerators and the primary heat exchanger is determined by the relative flows of the product stream and the waste stream.

FIGS. 3, 4, 5, and 6 illustrate other preferred embodiments of the invention. The numerals in these figures correspond to those in FIGS. 1 and 2 for all common elements and these elements will not be described again in detail.

Figure 3:
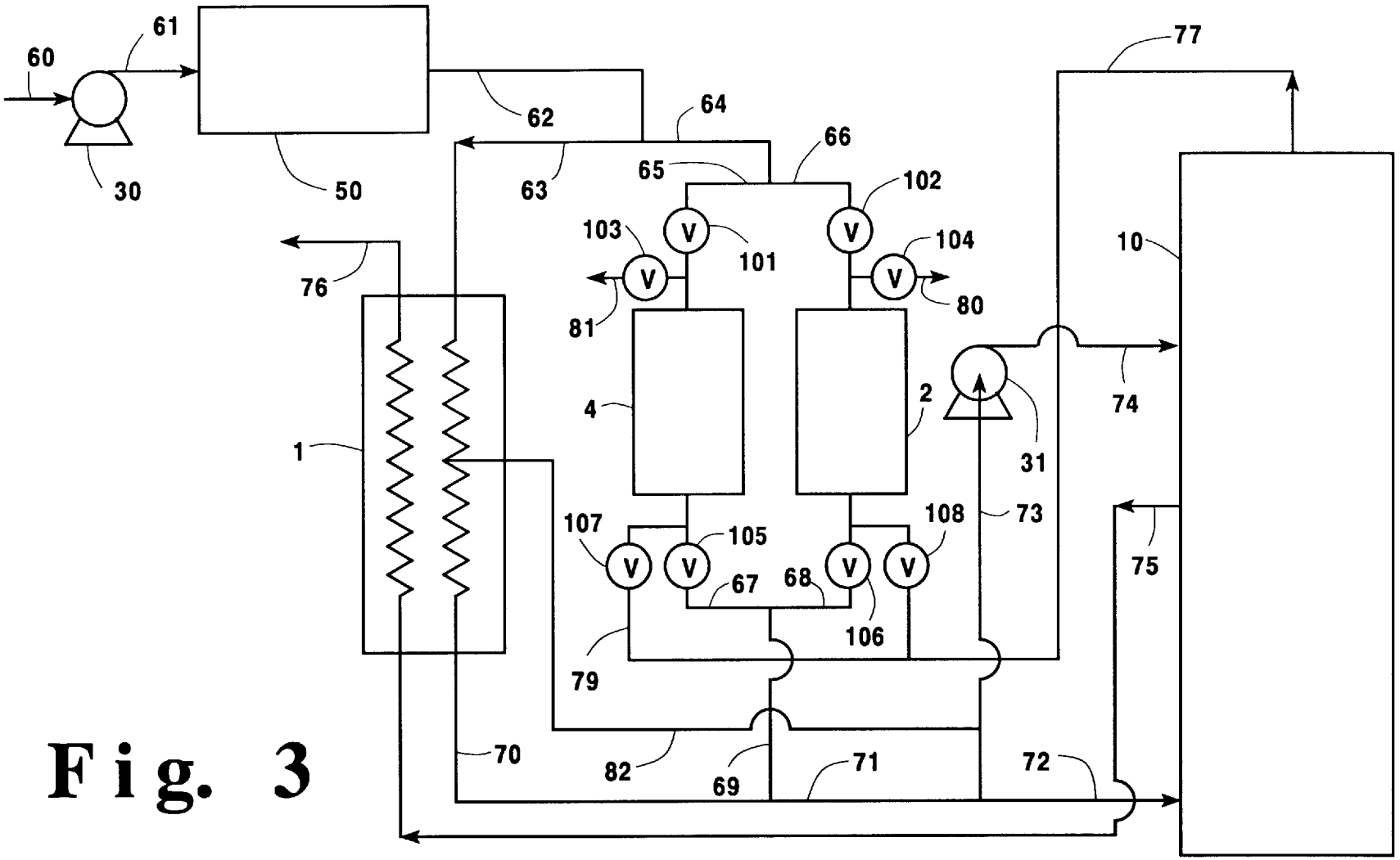
FIG. 3 is a schematic representation of a preferred embodiment of the invention wherein partially cooled air from the heat exchanger is fed to a turbine prior to separation.

Modern turbines have been shown to operate with high efficiencies with air that is essentially saturated. FIG. 1 shows the turbine being fed from the cold end of the regenerator. However, this scheme is not limited to this type of turbine feed. A side bleed of air may easily be withdrawn from a heat exchanger or a regenerator, allowing the cold and warm end temperatures to approach each other closely. This midpoint air may serve as a turbine feed. If it is desired to use preheat from a heat exchanger for the turbine feed, this is provided in another embodiment of this invention, as shown in FIG. 3. Partially-cooled air is withdrawn from the midpoint of primary heat exchanger 1, through piping 82, blended with a portion of the cold end air, from piping 83, for temperature control, and then passed to turbine 31 via piping 73. The air is then cooled by the turbine prior to entering the cryogenic separation section 10.

Figure 4:
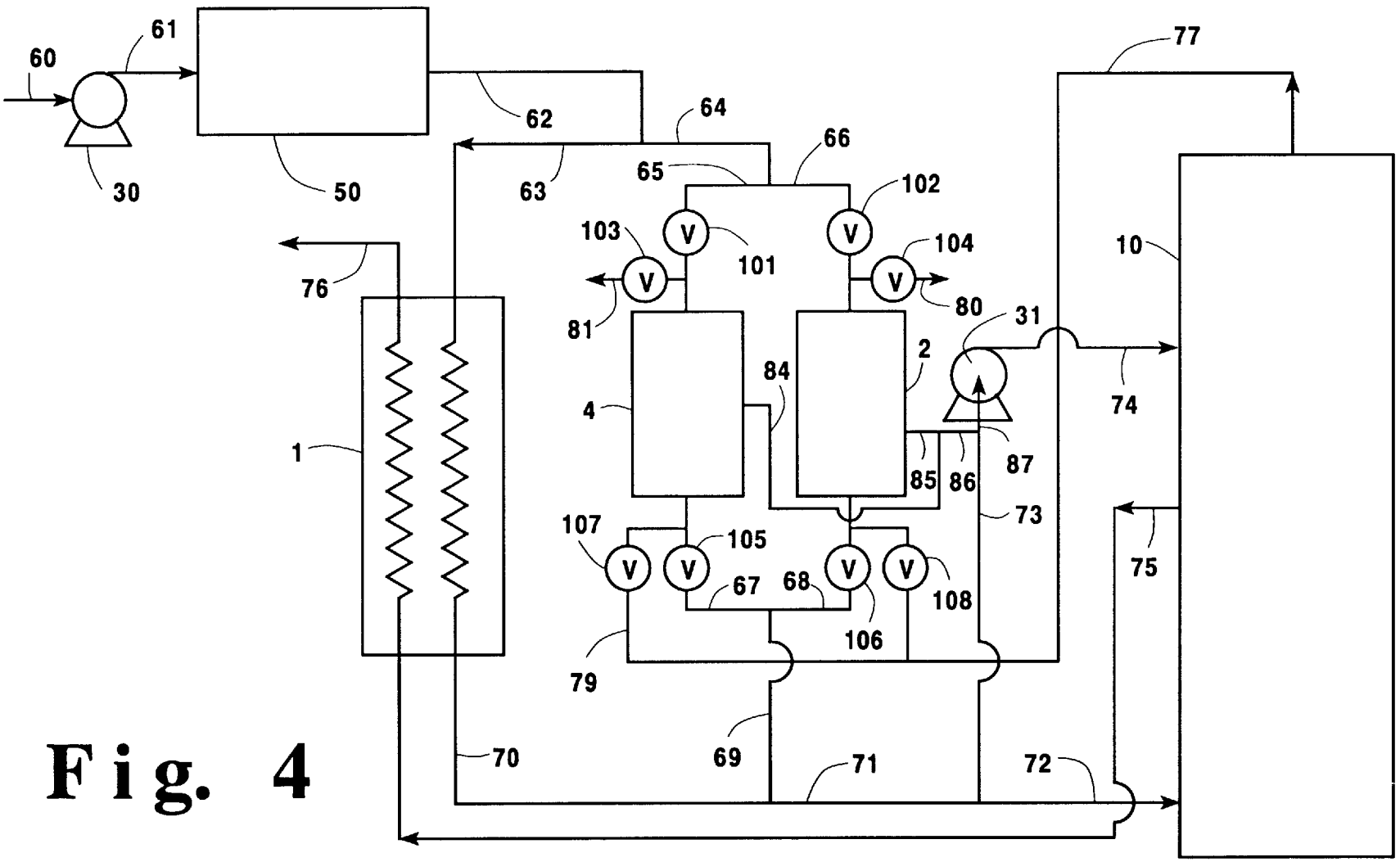
FIG. 4 is a schematic representation of a preferred embodiment of the invention wherein partially cooled air from a regenerator is fed to a turbine prior to separation.

FIG. 4 illustrates an embodiment of this invention in which turbine preheat is provided by withdrawing air from regenerator 2 at its midpoint through piping 85 and feeding it to turbine 31 through piping 86 and 87. Temperature control may be obtained by blending this air with regenerator cold end air fed to the turbine through valve 106, piping 68, 69, 71, 73, and 87. When regenerator 4 is being used to cool prepurified feed air, the preheat stream is withdrawn through piping 84 instead of piping 85.

Figure 5:
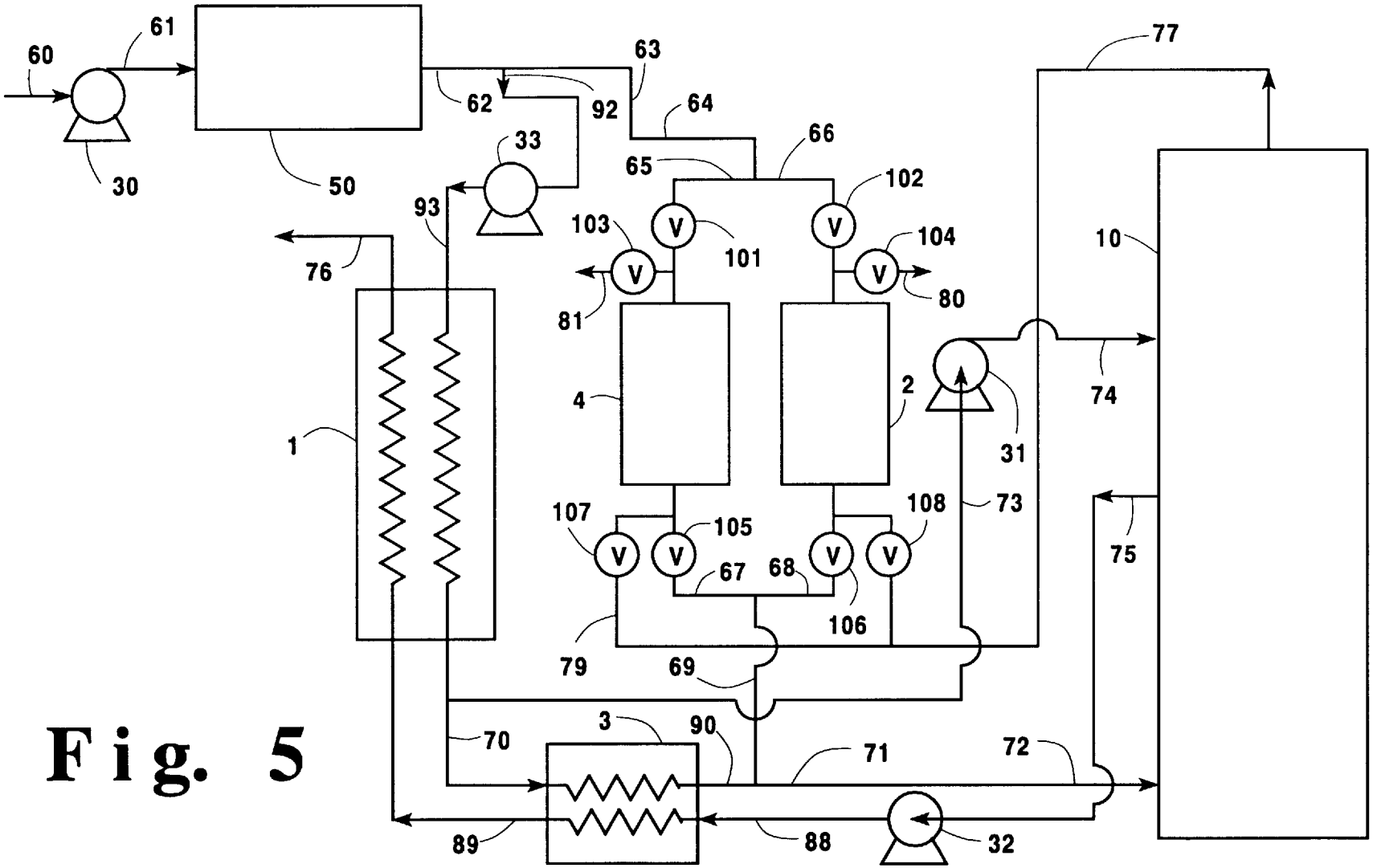
FIG. 5 is a schematic representation of a preferred embodiment of the invention wherein a booster compressor, a pressurizing pump, and a product boiler are used to produce a high-pressure product stream.

This invention is also applicable to use of a product boiler to deliver product at an elevated pressure. This embodiment of the invention is shown in FIG. 5. In this case liquid oxygen is withdrawn from the main condenser of the cryogenic separation plant in piping 75 and is pressurized by pump 32. Although the process is not limited to any pumped liquid pressure level, typical liquid pressure levels range from 20 psia to 500 psia, with preferred levels of 50 psia to 250 psia. The pressurized liquid oxygen passes through piping 88 and is then vaporized in product boiler 3 against cold end air from primary heat exchanger 1. A portion of the prepurified air passes through piping 92, is raised in pressure by booster compressor 33, and then is processed in primary heat exchanger 1 to provide the heat necessary in product boiler 3 to vaporize the liquid oxygen. The feed air used to vaporize the pressurized liquid oxygen will correspond in flow and pressure to the flow and pressure of the product stream. Generally, the feed air flow will be about 1.2 times the quantity of the product flow. The feed air pressure level will be above the pressure level of the product to allow cooling and condensation of the air feed versus the vaporizing product. Generally, the feed air pressure level will range from about 50 psia to about 1000 psia, with a preferred level of from about 100 psia to about 500 psia. The vaporized oxygen is passed through piping 89 and then warmed in primary heat exchanger 1 for delivery to the consumer via piping 76.

Figure 6:
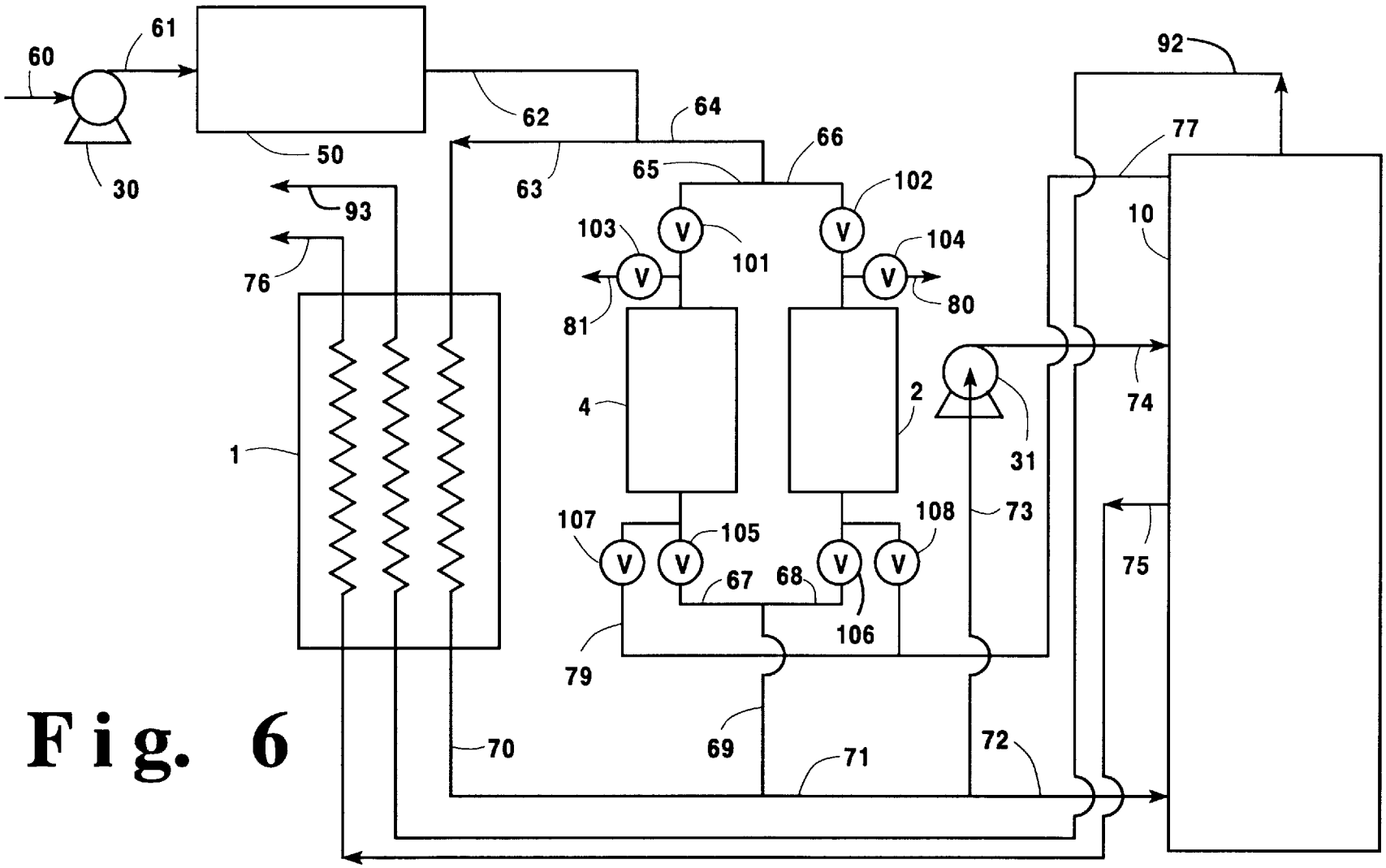
FIG. 6 is a schematic representation of a preferred embodiment of the invention wherein the configuration has been altered to allow two product streams.

This invention, in another embodiment, provides more than one clean product. An example of this embodiment is shown in FIG. 6 where both a clean oxygen product and a clean nitrogen product are produced. The nitrogen product stream leaves the cryogenic separation section in piping 92. Both clean product streams are passed through primary heat exchanger 1 in separate channels, the nitrogen exiting through piping 93 and the oxygen through piping 76. The two streams are balanced thermodynamically with the corresponding flow of feed air. The remaining feed air thus balances the waste stream in the regenerators. This provides flexibility in the application of this invention. As in all other preferred embodiments of this invention, the waste stream 77 is heated solely in the regenerators.

The method of this invention is not limited to operation with pairs of regenerators as shown in the preferred embodiments, but is equally operational with triplets of regenerators, or any other number of regenerators determined to be economical because of pressure drop, temperature differences, vessel or packing cost or valving and manifolding.

We claim:

1. A method for separation of air by cryogenic rectification comprising the steps of:

(a) compressing feed air which contains impurities;

(b) passing the compressed feed air through a prepurification system wherein the air is substantially cleaned of impurities;

(c) cooling the cleaned air by passage through a previously cooled regenerator while cooling another regenerator by passing a waste stream from a cryogenic air separation facility through this other regenerator;

(d) introducing the cooled air into the cryogenic air separation facility; and (e) withdrawing a product stream from the air separation facility.

2. The method of claim 1 wherein said previously cooled regenerator is provided by passing a waste stream withdrawn from the cryogenic air separation facility through the regenerator prior to the passage of the cleaned air through the cooled regenerator.

3. The method of claim 1 further comprising cooling a portion of the cleaned air taken from the prepurification system in a heat exchanger and passing the resulting air into the cryogenic air separation facility.

4. The method of claim 3 further comprising the step of warming the product stream in the heat exchanger while the cleaned air portion is being cooled in the heat exchanger.

5. The method of claim 4 further comprising withdrawing a second product stream from the cryogenic separation facility and passing that second product stream through the heat exchanger in a channel separate from that through which the said product stream flows.

6. The method of claim 1 wherein a portion of the cooled air is further cooled by a turbine prior to entering the cryogenic air separation facility.

7. The method of claim 6 wherein the portion of the air cooled by the turbine is taken from an intermediate point along the regenerator.

8. The method of claim 6 wherein the portion of the air cooled by the turbine is taken from an intermediate point along a heat exchanger.

9. A method for separation of air by cryogenic rectification comprising the steps of:

(a) compressing feed air which contains impurities;

(b) passing the compressed feed air through a prepurification system wherein the air is substantially cleaned of impurities;

(c) cooling the cleaned air by passage through a cooled regenerator;

(d) introducing the cooled air into a cryogenic air separation facility;

(e) withdrawing a product stream from the air separation facility; and (f) cooling a portion of the cleaned air taken from the prepurification system in a heat exchanger, passing the resulting air into the cryogenic air separation facility and warming the product stream in the heat exchanger while the cleaned air portion is being cooled in the heat exchanger.

10. A method for separation of air by cryogenic rectification comprising the steps of:

(a) compressing feed air which contains impurities;

(b) passing the compressed feed air through a prepurification system wherein the air is substantially cleaned of impurities;

(c) cooling the cleaned air by passage through a cooled regenerator;

(d) introducing the cooled air into a cryogenic air separation facility; and (e) withdrawing a product stream from the air separation facility;

wherein a portion of the cooled air is further cooled by a turbine prior to entering the cryogenic air separation facility, said portion being taken from an intermediate point along a heat exchanger.

* * * * *